US005613346A

United States Patent [19]

Yamamichi et al.

[11] Patent Number: 5,613,346

[45] Date of Patent: Mar. 25, 1997

[54] APPARATUS FOR REMOVING PACKING MATERIAL FROM PACKED ARTICLE

[75] Inventors: Takahiro Yamamichi; Hiroshi Shibata, both of Tokyo-to, Japan

[73] Assignee: Kirin Beer Kabushiki Kaisha, Tokyo-to, Japan

[21] Appl. No.: 635,781

[22] Filed: Apr. 22, 1996

Related U.S. Application Data

[63] Continuation of Ser. No. 229,745, Apr. 19, 1994, abandoned.

[30] Foreign Application Priority Data

Jun. 21, 1993 [JP] Japan ..... 5-149253

[51] Int. Cl.[6] ..... B65B 35/30; B65B 35/50; B65B 43/26; B67B 7/16

[52] U.S. Cl. ..... 53/381.1; 53/532; 221/229

[58] Field of Search ..... 53/381.1, 381.2, 53/492, 542, 532, 53, 54; 221/229, 290; 226/169, 182, 181, 193; 414/411, 412

[56] References Cited

U.S. PATENT DOCUMENTS

| | | | |
|---|---|---|---|
| 3,080,014 | 3/1963 | Dahl | 226/193 |
| 4,390,313 | 6/1983 | Hoehn | 53/381.2 |
| 4,696,615 | 9/1987 | Ettischer et al. | 53/381.2 |
| 4,997,329 | 3/1991 | Hanamoto et al. | 414/412 |
| 5,138,341 | 8/1992 | Kobayashi | 226/193 |
| 5,275,524 | 1/1994 | Ishiwata | 53/381.2 |

FOREIGN PATENT DOCUMENTS

| | | | |
|---|---|---|---|
| 2010771 | 7/1979 | United Kingdom | 414/412 |

*Primary Examiner*—John Sipos
*Assistant Examiner*—Rodney A. Butier
*Attorney, Agent, or Firm*—Oblon, Spivak, McClelland, Maier & Neustadt, P.C.

[57] ABSTRACT

A packing material removal apparatus for removing a packing material from a package including combined articles herein and supplying the combined articles to a next process by a supplying unit, comprises a cutting unit having a suction opening for sucking the packing material to form a slack section, and a cutter for cutting the slack section, a removal unit having a pair of removal rollers which rotate in opposite directions to each other and on which the package cut by the cutting unit is put, and a drop unit having a transferring board, a shutter board for preventing the combined articles from being transferred to the supplying unit and permitting the combined articles to be sent to the supplying unit, an operation device for moving the shutter board upwardly and downwardly with respect to the transferring board, and side boards for supporting both ends of the combined articles on the transferring board.

20 Claims, 17 Drawing Sheets

C

APPARATUS FOR REMOVING PACKING MATERIAL FROM PACKED ARTICLE

This application is a continuation of application Ser. No. 08/229,745, filed on Apr. 19, 1994, now abandoned.

FIELD OF THE INVENTION

This invention relates to an apparatus for removing packing material from a packaged good or article in manufacturing process to supply the good or article to a following process.

BACKGROUND OF THE INVENTION

Generally, in a canning process in which contents, such as beer, beverage, food, engine oil, etc., are filled up in a can, the can is sealed in such a manner that the mouth of the can body is covered with a can lid to be seamed with each other after the contents are filled up in the can body.

The can lid is manufactured separately from the can body and a plurality of can lids are piled up in a pillar shape to be packed by a packing material. Thereafter, in the canning process, the lids are supplied one by one to the can bodies in which contents are filled up to be seamed with the can body after removing the packing material from the package of can lids.

The applicant already proposed an apparatus which is mentioned in Japanese Patent Application No. 63-322608 as an apparatus for removing packing material which packs can lids piled in a pillar shape.

Namely, the apparatus has a suction mechanism for sucking the package of the can lids supplied to the canning process. The suction mechanism sucks the packing material of the packed can lids to form a slack or loosened section between the can lids and the packing material. And, after cutting the slack section by a cutter to form an opening, a packing material removal unit removes the packing material cut by the cutter from the can lids.

However, in the above mentioned apparatus, there is a problem as follows. Namely, the can lids are easily separated from each other in a feeding process in which the can lids are fed to a seamer after the packing material is removed from the package of the can lids piled up in the pillar shape. If the can lids are separated, the works must be stopped.

The above mentioned problem exists not only in an apparatus for removing packing material from the package of can lids in the canning process, but also in various packing material removal apparatuses for removing packing material from packed goods in various manufacturing processes.

SUMMARY OF THE INVENTION

An object of this invention is to provide a packing material removal apparatus in which articles or goods combined in a line are not separated from each other even after packing material is removed from the combined articles and the combined articles can be smoothly supplied to a manufacturing process.

The packing material removal apparatus according to this invention can remove a sheet-like packing material from a package thereby to supply the combined articles to the next process through a supplying unit. The packing material removal apparatus comprises a cutting unit having a suction opening for sucking the packing material to form a slack section which forms a space between the packing material and the combined articles, and a cutter for cutting the slack section, a removal unit having a pair of removal rollers which rotate in opposite direction to each other while supporting the package cut by the cutting unit in order to remove the packing material from the package by biting the packing material between the removal rollers, and a dropping unit having a transfer board provided, between the removal unit and the supplying unit, in a state of declining from the removal rollers toward the supplying unit, the combined articles whose packing material is removed by the removal unit, rolling down on the transfer board, a shutter board provided parallel to the removal rollers and moved up and down to stop the combined articles on the transfer board and to release the combined articles to the supplying unit, an operation means for moving the shutter board up and down with respect to the transfer board, and side boards provided in a standing condition at both sides of the transfer board for supporting both ends of the combined articles on the transfer board.

The above mentioned packing material removal apparatus sucks the package conveyed to the packing material cutting unit to form a slack section of the packing material which is cut by a cutter.

The package with packing material to be cut is put on the removal rollers to remove the cut packing material from the combined articles by biting the packing material between the removal rollers which is rotated in opposite direction to each other.

The combined articles whose packing material is removed is transferred from the removal rollers to the transfer board. Both ends of the combined articles are supported by the side boards to prevent the combined articles from being separated from each other. When the shutter board is lowered to the underside of the transfer board by the operation means, the combined articles on the transfer board roll down to the supplying unit while both ends of the combined articles are supported by the side boards. Thus the combined articles are supplied to the next process.

According to this invention mentioned above, two shutter boards may be provided so as to be operated alternately to transfer, step by step, the combined articles to the supplying unit whereby the combined articles without the packing material can be completely prevented from being separated from each other.

It is desirable to form a plurality of grooves on the removal rollers to prevent a slip between the packing material and the removal rollers. Further, the biting of the packing material between the removal rollers can be prevented if the grooves are intermittently formed.

In addition, it is desirable that the removal unit is provided with a press plate which can swing in the axial direction of the removal rollers, and which touches the front end face of the package put on the removal rollers, and is urged by an elastic member toward the front end of the package.

Furthermore, it is desirable to form two side boards in the drop unit so as to be moved to adjust the distance between the two side boards.

DETAILED DESCRIPTION OF THE PREFERRED EMBODIMENTS

Hereinbelow, the embodiments of this invention are explained with reference to the drawings.

The following embodiments indicate a case where this invention is applied to a packing material removal apparatus for the package of can lids installed in a canning process.

Figure 1:
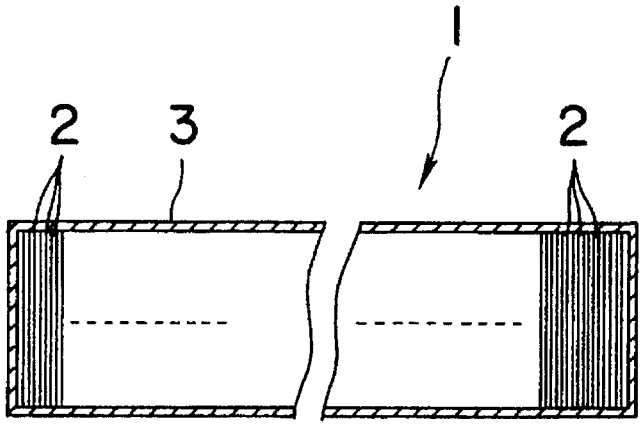
FIG. 1 is a longitudinal sectional view of a package handled by a packing material removal apparatus of this invention.

FIG. 1 indicates a package 1 which includes a number of disk-like can lids 2 arranged adjacently in a pillar shape, and a sheet-like packing material 3 with which the combined pillar shaped can lids 2 is covered.

Figure 2:
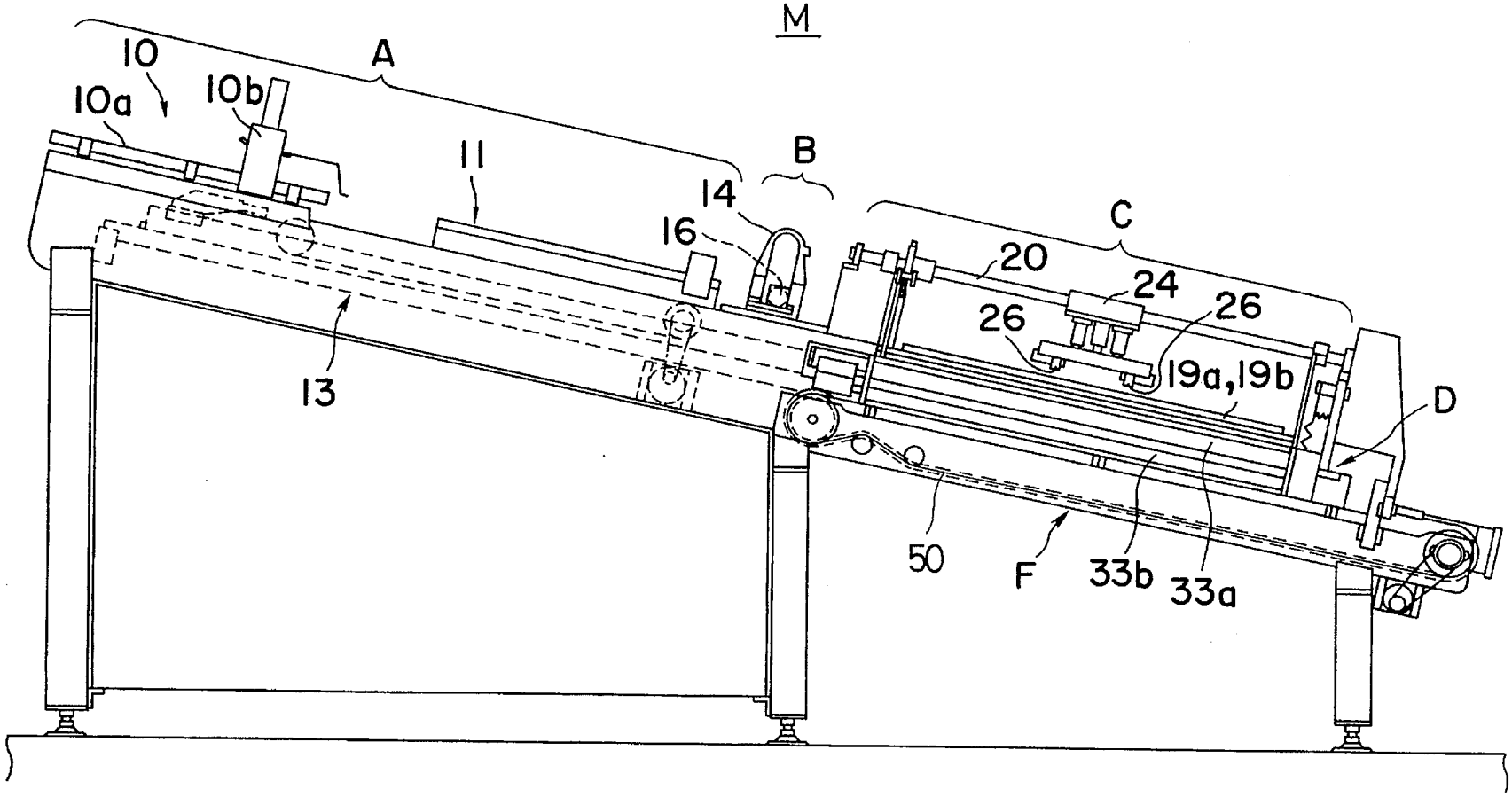
FIG. 2 is a side view of the packing material removal apparatus of this invention.
Figure 3:
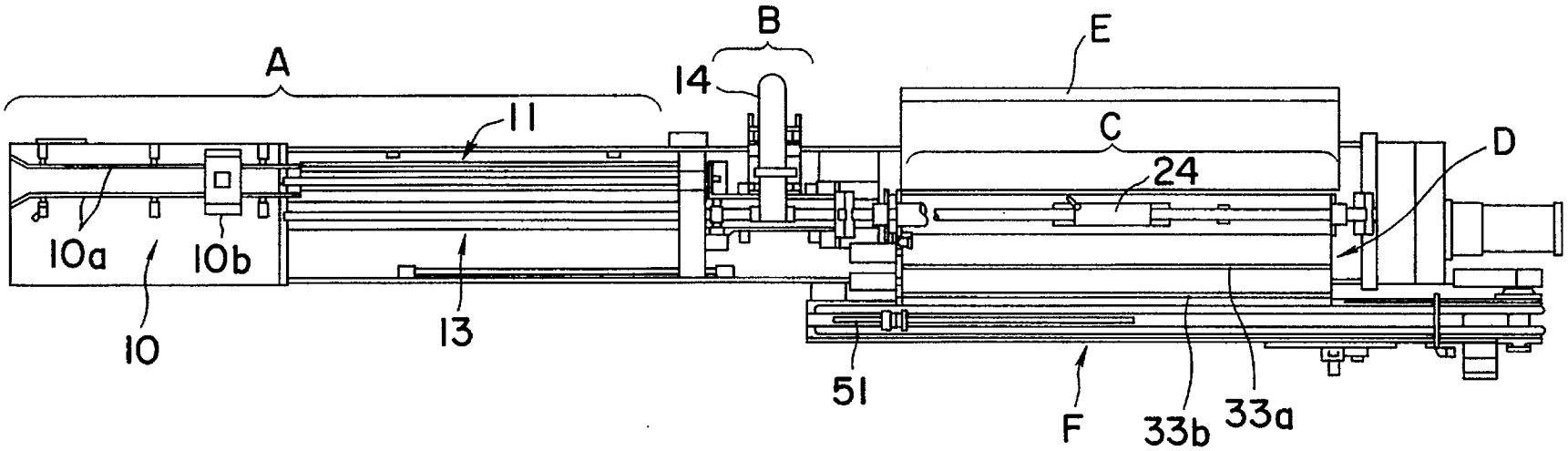
FIG. 3 is a plan view of the packing material removal apparatus shown in FIG. 2.

FIG. 2 is a side view showing a packing material removal apparatus M for removing the packing material 3 from the package 1 of the can lids to supply the can lid 2 to a seamer (not illustrated). FIG. 3 is a plan view of the packing material removal apparatus M.

In FIGS. 2 and 3, the packing material removal apparatus comprises, as viewed from the left in FIG. 2, a carrying unit A for carrying the package 1, a packing material cutting unit B for cutting a part of the packing material 3 and a packing material removal unit C for removing the packing material 3 from the package 1.

Further, the packing material removal apparatus M comprises a dropping unit D disposed adjacent to the packing material removal unit C for transferring the pillar-like can lids 2 from which the packing material 3 is removed in the packing material removal unit C, a discharge unit E disposed parallel to the packing material removal unit C on the opposite side of the dropping unit D for discharging the package 1 from which the packing material 3 is not completely removed, and a supplying unit F for supplying the pillar-like can lids 2 to a following process.

The package 1 is carried one by one through the carrying unit A, the packing material cutting unit B, the packing material removal unit C, and the dropping unit D and the supplying unit F in this order, and a defective package 1 in which the packing material 3 is not completely removed is discharged to the discharge unit E from the packing material removal unit C. The carrying unit A carries the package 1 to the packing material removal unit C via the packing material cutting unit B.

Figure 4:
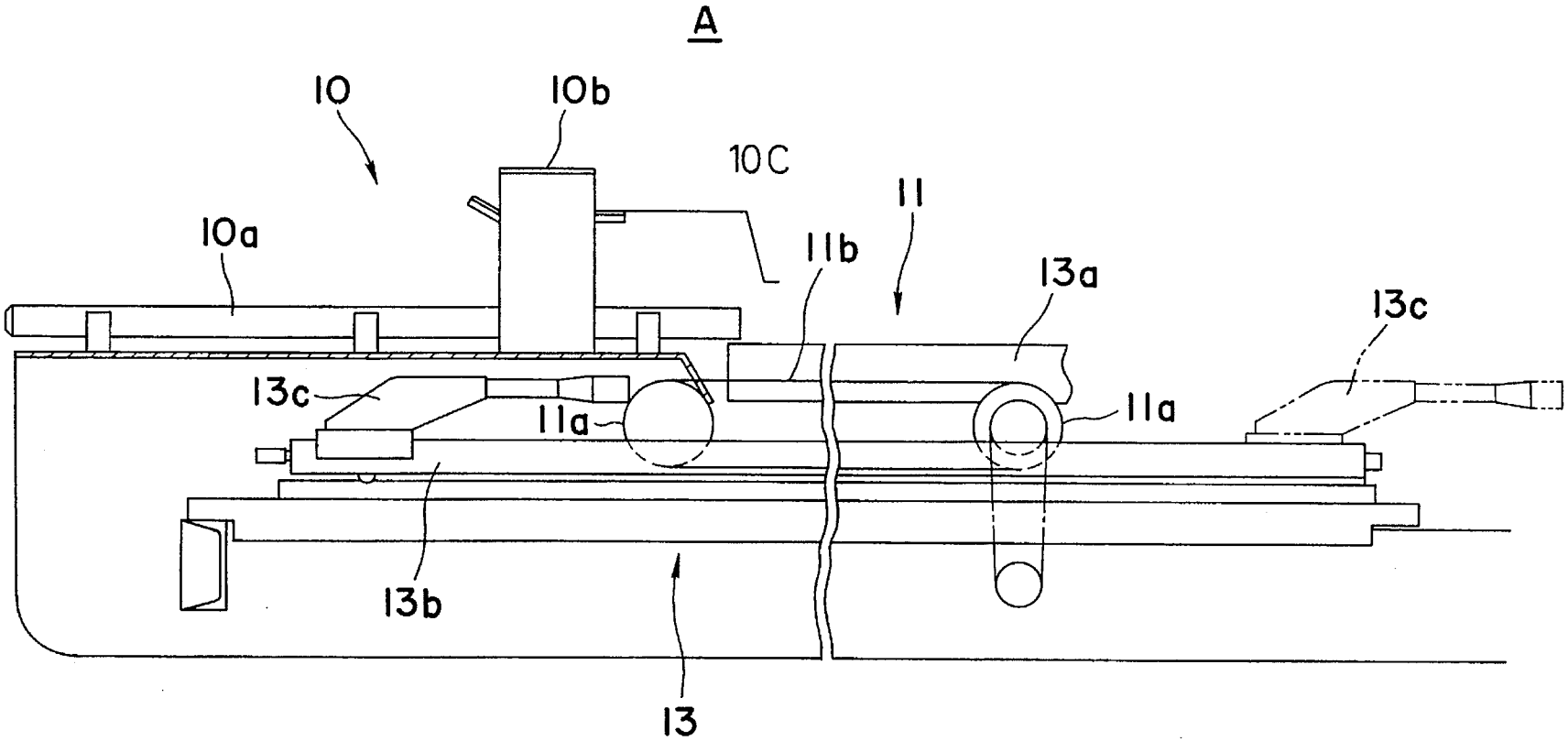
FIG. 4 is a side view of a carrying unit of the packing material removal apparatus shown in FIGS. 2 and 3.
Figure 5:
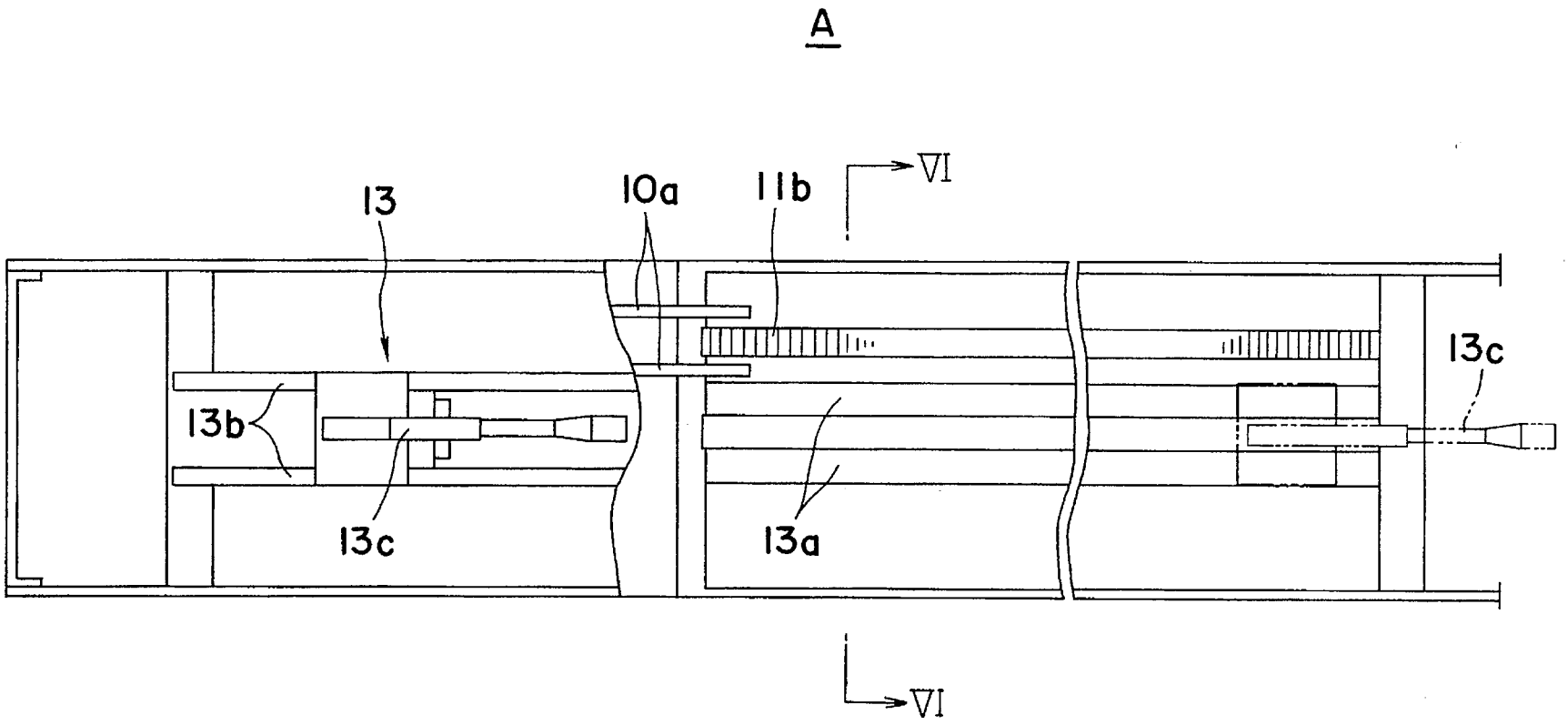
FIG. 5 is a plan view of the carrying unit shown in FIG. 4.
Figure 6:
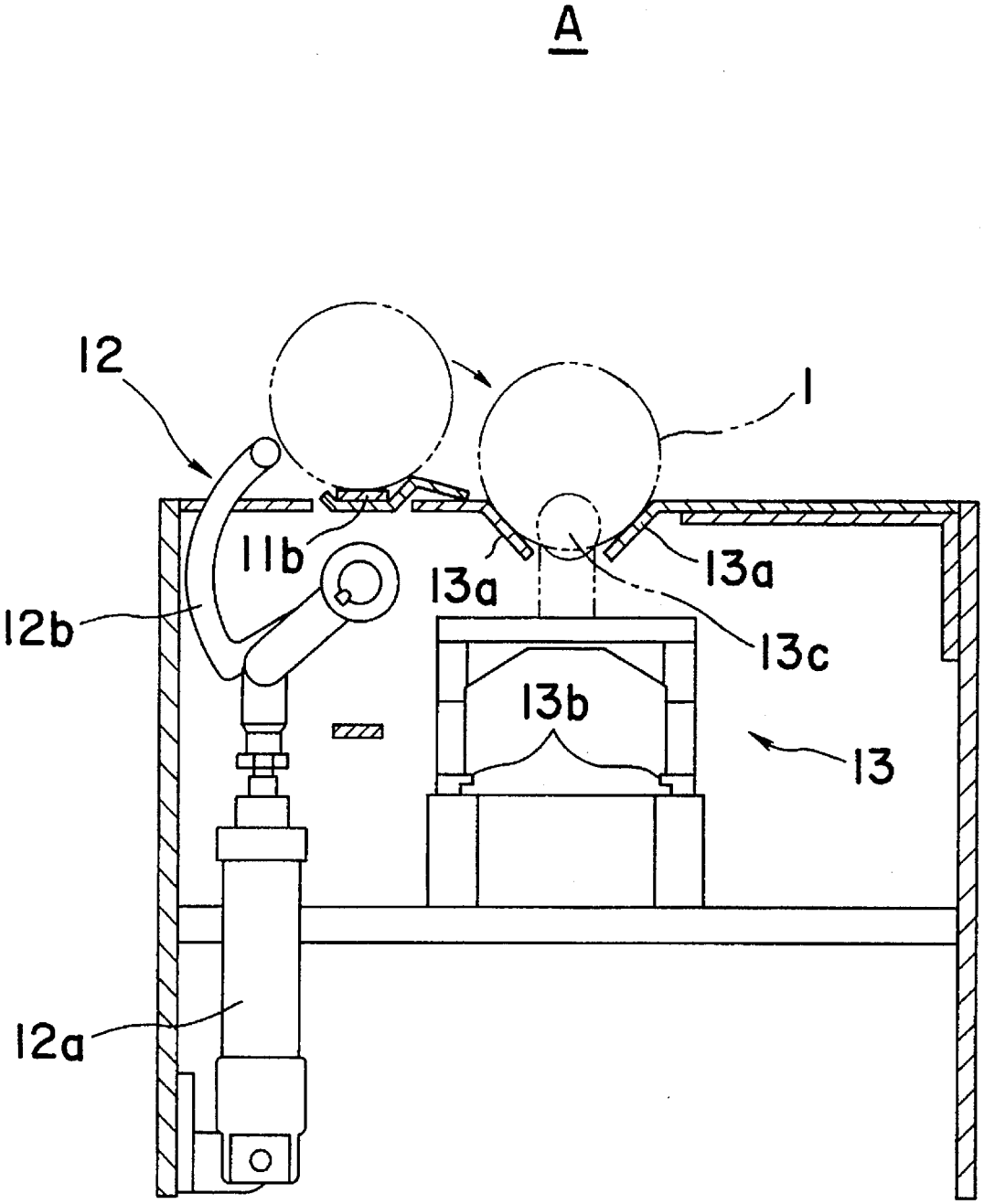
FIG. 6 is a cross sectional view taken along the line VI—VI in FIG. 5.

As enlargedly shown in FIGS. 4 to 6, the carrying unit A comprises a feeding section 10 having a pair of guide plates 10*a*, which are disposed parallel to each other, a stopper mechanism 10*b* having a stopper 10*c* swingable over the guide plates 10*a* for stopping and releasing the package 1, a waiting section 11 having an endless timing belt 11*b* provided between a pair of sprockets 11*a*, a transferring section 12 having a swing arm 12*b* disposed adjacent to the waiting part 11 and swung by a cylinder 12*a*, and a carrying section 13 having a pair of guide portions 13*a*, 13*a* disposed parallel to the endless timing belt 11*b* and a pusher 13*c* disposed between the guide portions 13*a* so as to move forward and backward along the rails 13*b*, 13*b*.

Figure 7:
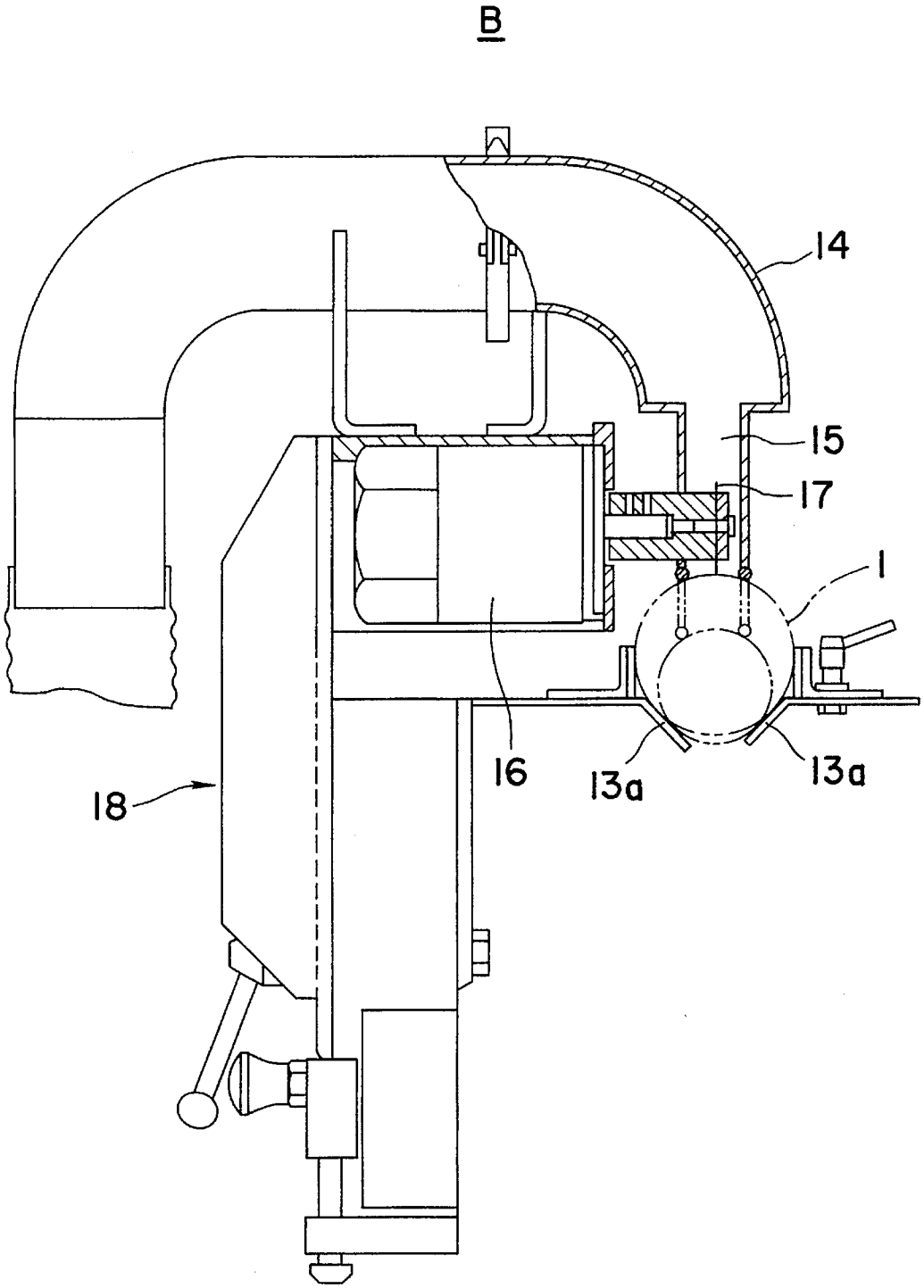
FIG. 7 is a cross sectional view of a packing material cutting unit for cutting packing material according to this invention.

The packing material cutting unit B cuts the packing material 3 of the package 1 which is carried from the carrying unit A. As enlargedly shown in FIGS. 7, 8, the packing material cutting unit B comprises a suction opening 15 disposed at an upper position on the downstream side of the guide portions 13*a* and connected to a suction source (not illustrated) via a suction duct 14, a cutter 17 disposed inside of the suction opening 15 and rotated by a motor 16, and a support body 18 for supporting the suction opening 15, the motor 16 and the cutter 17 to adjust the height of those members.

The packing material removal unit C removes the packing material 3 which is cut from the package 1 by the packing material cutting unit B. As enlargedly shown in FIGS. 9 to 12, the packing material removal unit C comprises a pair of removal rollers 19*a* and 19*b* disposed in alignment with the guide portions 13*a* and parallel to each other to be respectively rotated inwardly in opposite directions to each other, a shaft 20 disposed over the removal rollers 19*a* and 19*b*, a cylinder 21 connected to one end portion of the shaft 20 to rotate the shaft 20 around its axis, a pair of swinging plates 22, 22 respectively suspended from both ends of the shaft 20 so as to swing in accordance with rotation of the shaft 20, a pair of bars 23 disposed parallel to each other and provided between the swing plates 22, a pair of press rollers 26, 26 suspended from a movable sleeve 24 which is slidable along the shaft 20 so as to be moved up and down by a cylinder 25, a shutter 29 installed at a bracket 27 slidable along the shaft 20 so as to swing on a plane perpendicular to the shaft 20, an end stopper 30 disposed on the downstream side of the removal rollers 19*a*, 19*b*, a removal shoot 40 disposed under the removal rollers 19*a*, 19*b*, and a sensor S installed at the removal shoot 40 for sensing a dropping of the packing material 3.

Figure 13:
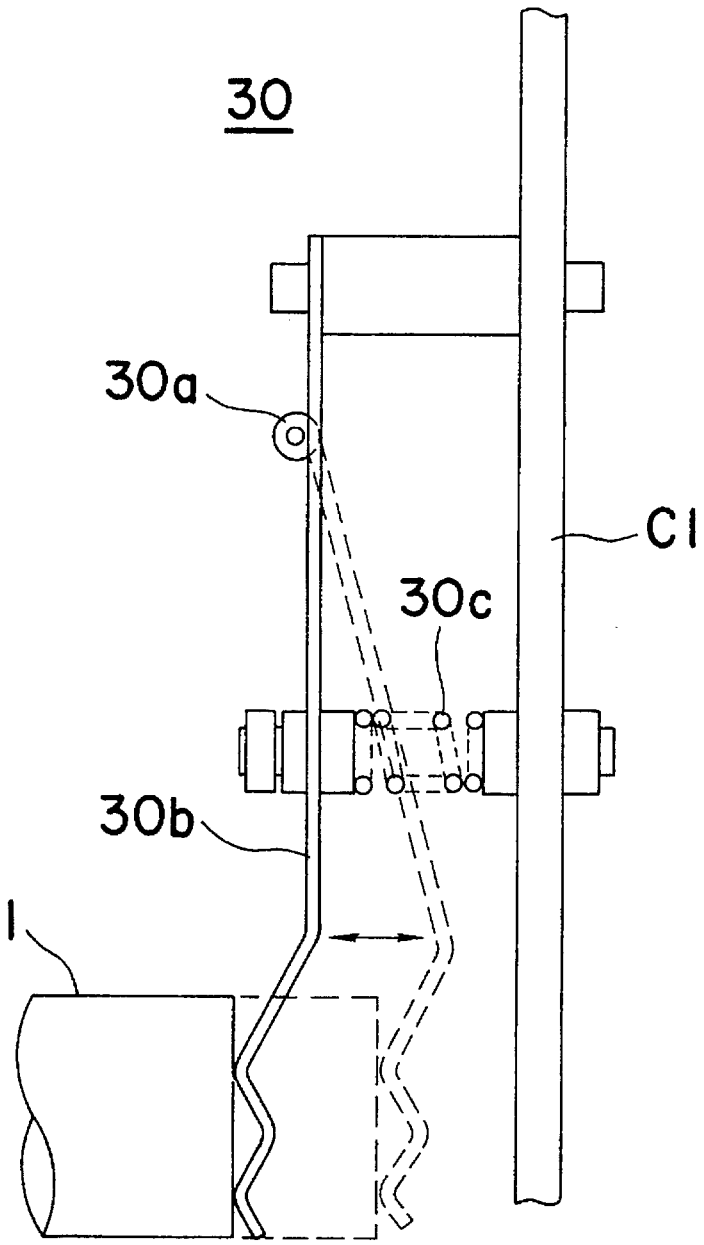
FIG. 13 is a side view of an end stopper used in the packing material removal unit in FIGS. 9, 10 and 11.

As enlargedly shown in FIG. 13, the end stopper 30 comprises a press plate 30*b* whose upper end portion is fixed to a frame C1 of the packing material removal unit C and which can swing on a plane parallel to the removal rollers 19*a*, 19*b* by a hinge 30*a*, and a spring 30*c* disposed between the press plate 30*b* and the frame C1 for urging the press plate 30*b* in the upstream direction of the removal rollers 19*a*, 19*b*. The end stopper 30 is so formed that the lower portion of the press plate 30*b* can contact an end surface of the package 1 supported on the removal rollers 19*a*, 19*b*.

Figure 14:
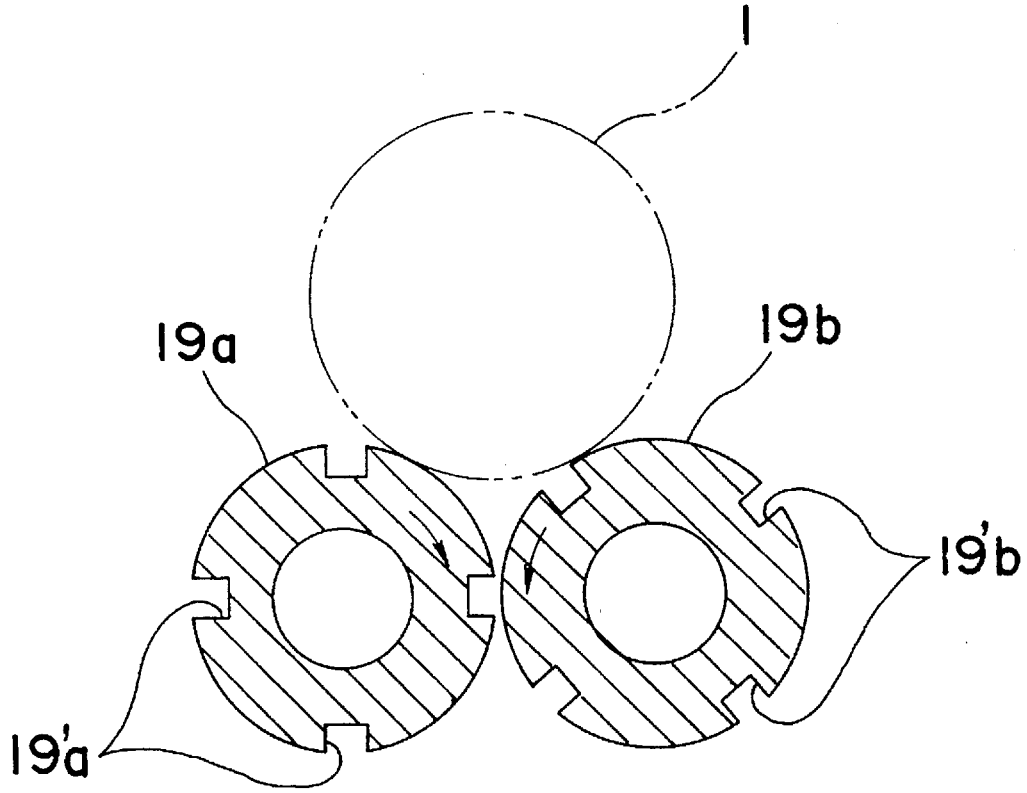
FIG. 14 is a sectional view of a pair of removal rollers taken along the line XIV—XIV.
Figure 15:
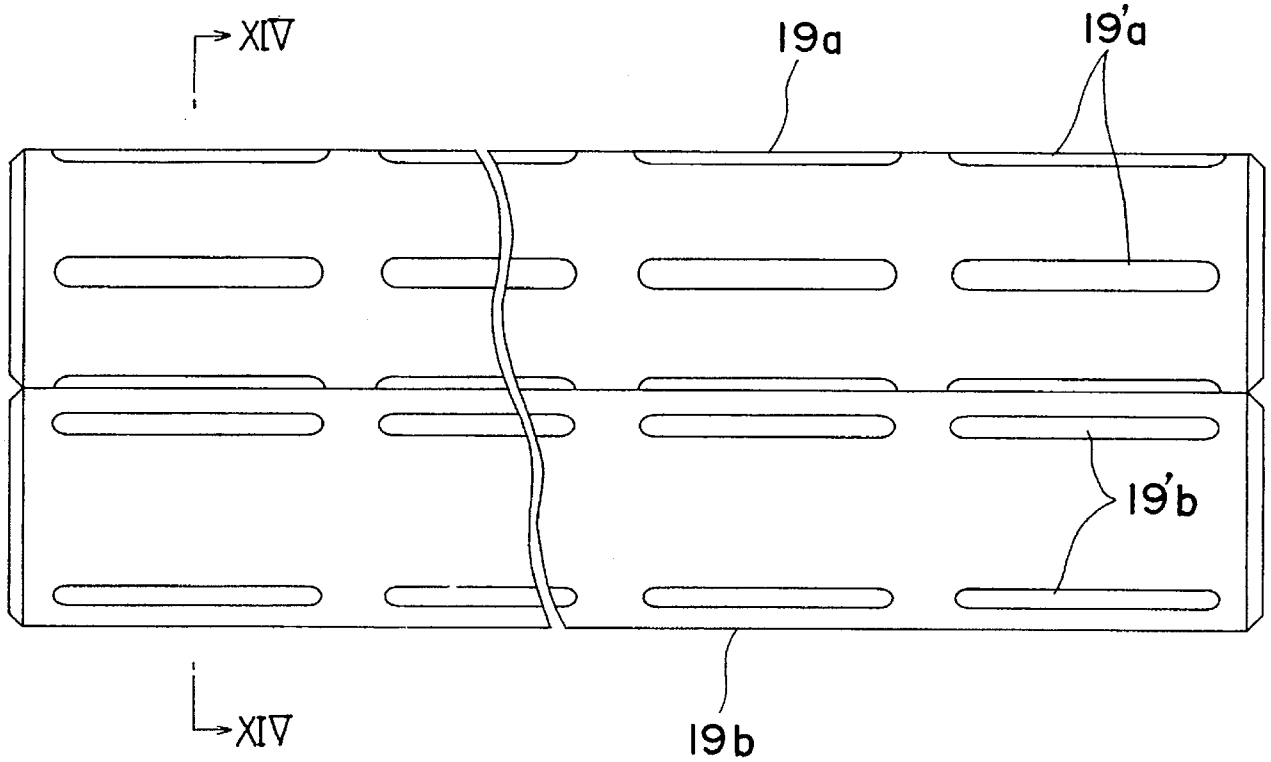
FIG. 15 is a plan view of the removal roller in FIG. 14.

As shown in FIGS. 14 and 15, on an outer circumferential surface of the removal rollers 19*a*, 19*b*, a plurality of grooves 19'*a*, 19'*b* are extended at predetermined intervals in the axial and circumferential directions of the removal rollers 19*a*, 19*b*. As is apparently shown in FIG. 15, the grooves 19'*a*, 19'*b* are not continuously formed in the axial direction of the removal rollers 19*a*, 19*b* but intermittently formed.

The dropping unit D transfers the combined can lids 2 whose packing material 3 has been removed in the packing material removal unit C to the supplying unit F.

Figure 16:
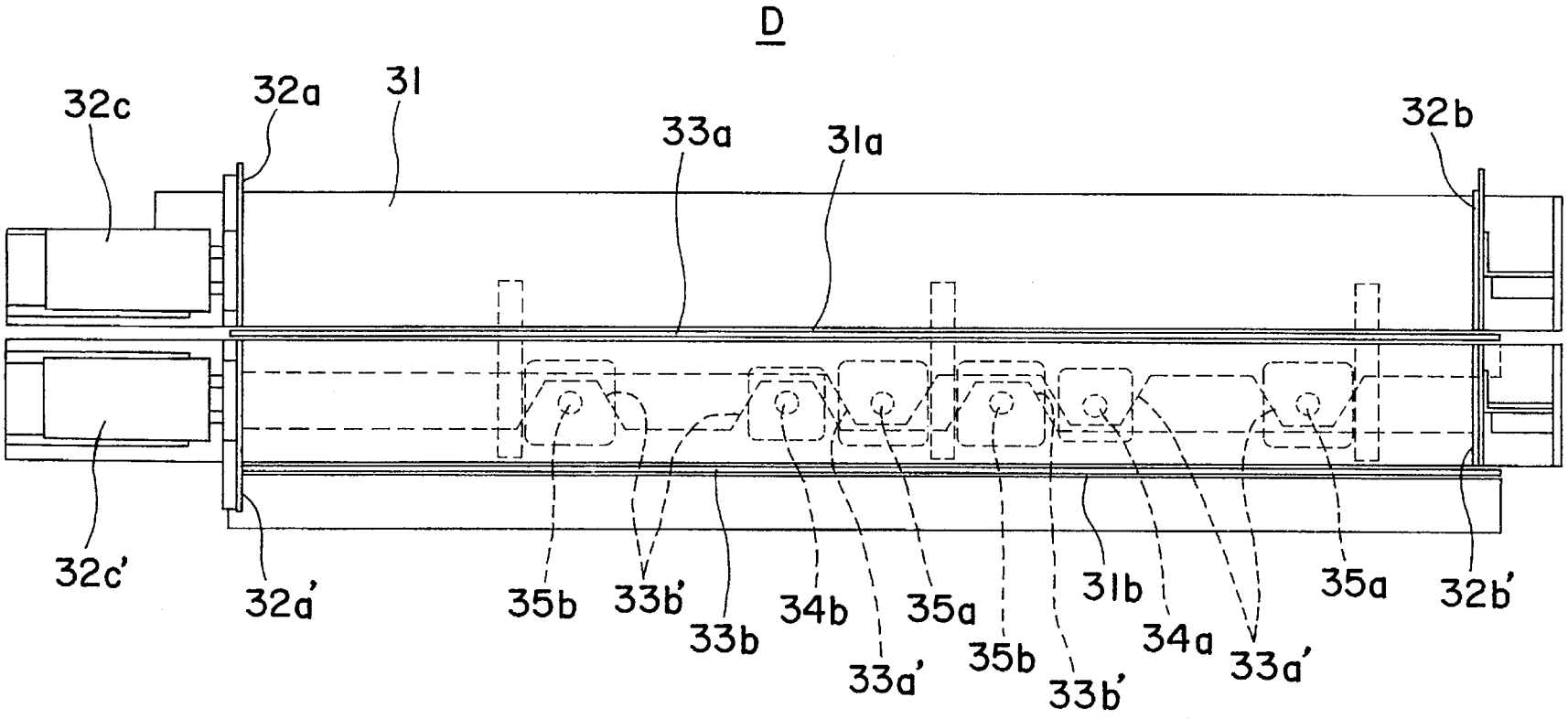
FIG. 16 is a plan view of a dropping unit for transferring can lids arranged in a pillar shape to a discharge unit.
Figure 17:
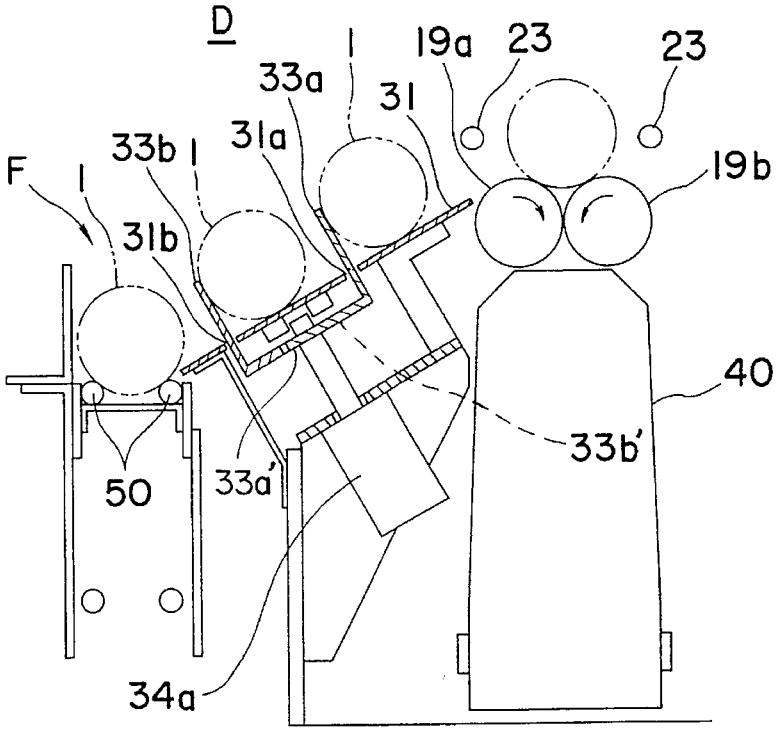
FIG. 17 is a cross sectional view of the dropping unit in FIG. 16.

As enlargedly shown in FIGS. 16 and 17, the dropping unit D comprises a transferring board 31 disposed inclinedly between the side surface of the left removal roller 19*a* and the supplying unit F (a mechanism for supplying the can lids 2 to the seamer) disposed at a lower position than the removal rollers 19*a*, 19*b*, side boards 32*a*, 32*a*'; 32*b*, 32*b*' respectively provided upright on both ends of the transferring board 31 in such a manner that the distances between the boards 32*a*, 32*a*' and between the boards 32*b*, 32*b*' are a little larger than the length of the combined can lids in its axial direction, a pair of shutter boards 33*a*, 33*b* disposed parallel to each other and projected from the lower side of the transfer board 31 through two opening slots 31*a*, 31*b* formed in the transferring board 31, a pair of cylinders 34*a*, 34*b* provided under the transfer board 31 and connected to the shutter boards 33*a*, 33*b*, respectively, and two pairs of guide shafts 35*a*, 35*b* for respectively guiding upward and downward movements of shutter boards 33*a*, 33*b*.

The opening slots 31*a*, 31*b* are respectively formed parallel to the removal rollers 19*a*, 19*b* so that two distances between the left removal roller 19*a* disposed on the left side in FIG. 17 and the opening slot 31*a* formed on the side of the removal roller 19*a* and between the opening slot 31*a* and the opening slot 31*b* are slightly larger than the diameter of the lid 2. Therefore, the shutter boards 33*a*, 33*b* are also disposed parallel to the removal rollers 19*a*, 19*b* so that the distance between the two shutter boards 33*a* and 33*b* is slightly larger than the diameter of the lid 2.

The opening slot 31*b* on the left side as viewed in FIG. 17 is disposed as nearly as possible to the supplying unit F.

The shutter boards 33*a*, 33*b* have two support portions 33*a*' 33*b*' formed by bending the lower portions thereof to be connected to the cylinders 34*a*, 34*b*, respectively. The support portions 33*a*', 33*b*' are disposed under the transfer board 31 so as to be faced to each other. These flange 33*a*', 33*b*' are, as is best shown in FIG. 16 formed so that the edges faced to each other have concave-convex form in a complementary manner.

Figure 18:
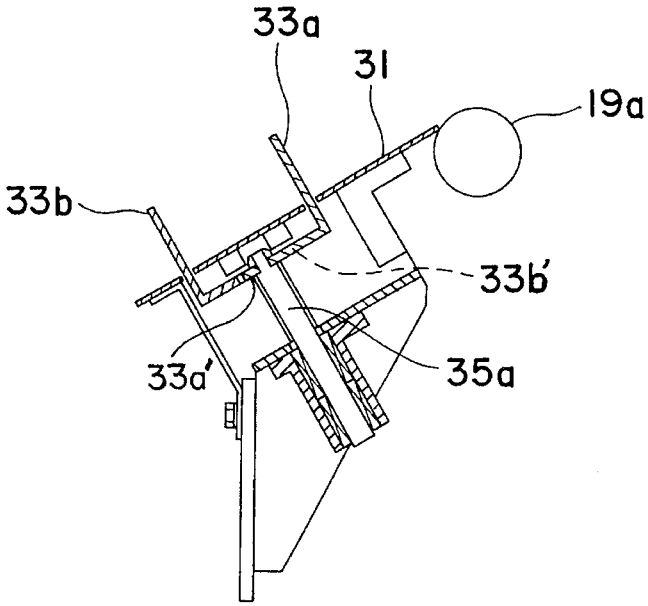
FIG. 18 is a cross sectional view of a guide shaft of the dropping unit in FIGS. 16 and 17.

The cylinders 34*a*, 34*b* are, as is apparent from FIG. 17, arranged parallel to the shutter boards 33*a*, 33*b* under the support portions 33*a*', 33*b*', and the operating shaft of each cylinder is connected to a convex portion of each of the support portions 33*a*', 33*b*'. Moreover, as shown in FIG. 18, the guide shafts 35*a*, 35*b* are arranged in alignment with the operating shafts of the cylinders 34*a* and 34*b*. These guide shafts 35*a*, 35*b* are connected to the convex portions of the support portions 33*a*', 33*b*', respectively, so that the shutter boards 33*a*, 33*b* are moved up and down in the direction perpendicular to the transferring board 31.

The side boards 32*a*, 32*a*' are slidably installed to the transfer board 31, and connected to two cylinders 32*c*, 32*c*' as an operating means, respectively, so that the distance between the side boards 32*a*, 32*b* and between the side boards 32*a*', 32*b*' can be adjusted in accordance with the length of the combined can lids without the packing material.

Figure 12:
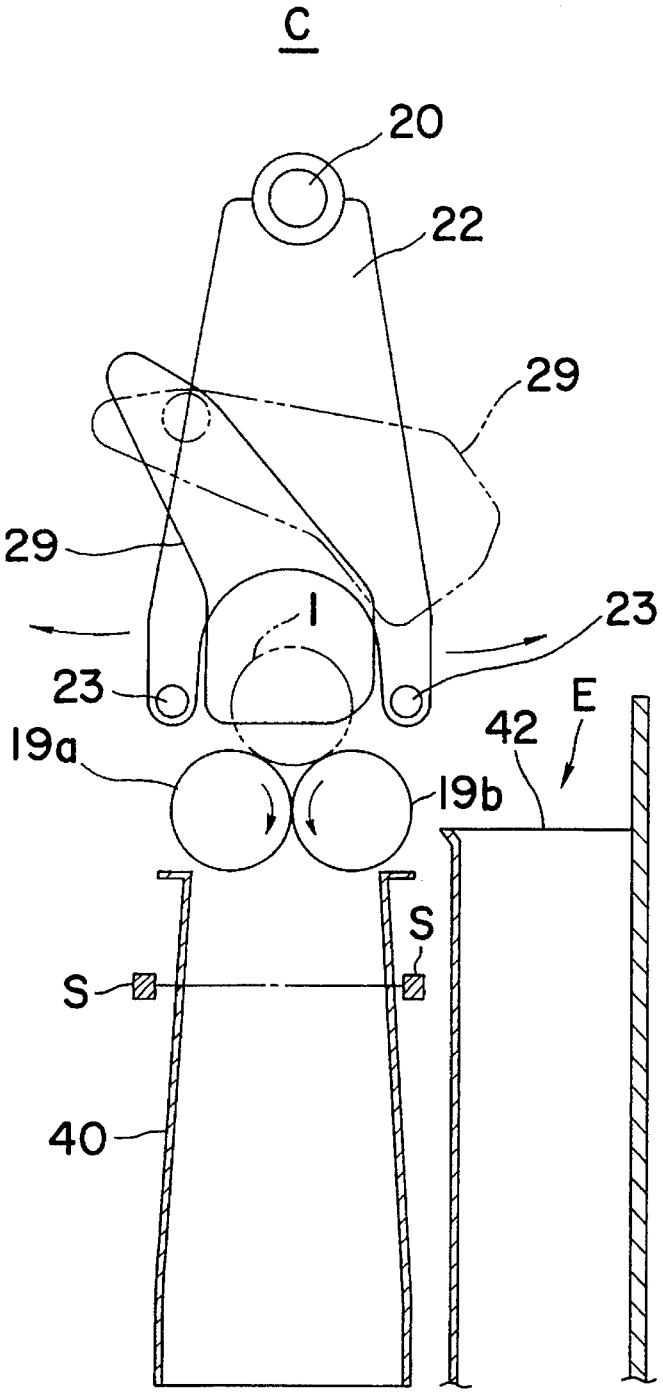
FIG. 12 is an explanatory view for explaining an operation of the packing material removal unit in FIGS. 9, 10, and 11.

The discharge unit E receives the defective package 1 from which the packing material 3 is not completely removed. As shown in FIG. 12, the discharge unit E is disposed on the opposite side of the drop unit D, in the packing material removal unit C and has a discharge shoot 42 whose opening is disposed near the right removal roller 19*b*.

The supplying unit F supplies the can lids 2 transferred by the dropping unit D to the seamer (not shown). The supplying unit F has an endless belt 50 disposed parallel to the removal rollers 19*a*, 19*b*, and a cylinder 51 for pushing the back end portion of the can lids 2 in the supplying direction.

An operation of the above mentioned packing material removal apparatus will now be explained.

The package 1 carried to the feeding section 10 of the carry unit A by a conveyer (not shown) moves forward to the stop mechanism 10*b* along the Guide plates 10*a*. The stopper mechanism 10*b* permits the package 1 to move forward to the waiting section 11 when no package 1 exists in the waiting section 11, and stops the package 1 when the package 1 exists in waiting section 11.

The package 1 having already passed through the stopper mechanism 10*b* is put on the endless timing belt 11*b* in the waiting section 11, and conveyed to a waiting position in accordance with rotation of the sprockets 11*a*. When the cutting operation of a package 1 located in the removal unit B is finished in the packing material removal unit B, as mentioned in detail later, a package 1 located at the waiting position is transferred from the waiting section 11 to the guide portions 13*a* by operating the cylinder 12*a* to swing the swing arm 12*b*.

The package 1 transferred to the carrying section 13 is conveyed to the packing material removal unit B along the guide portions 13*a* by being pushed by the pusher 13*c* which moves forward on the rail 13*b*.

Figure 8:
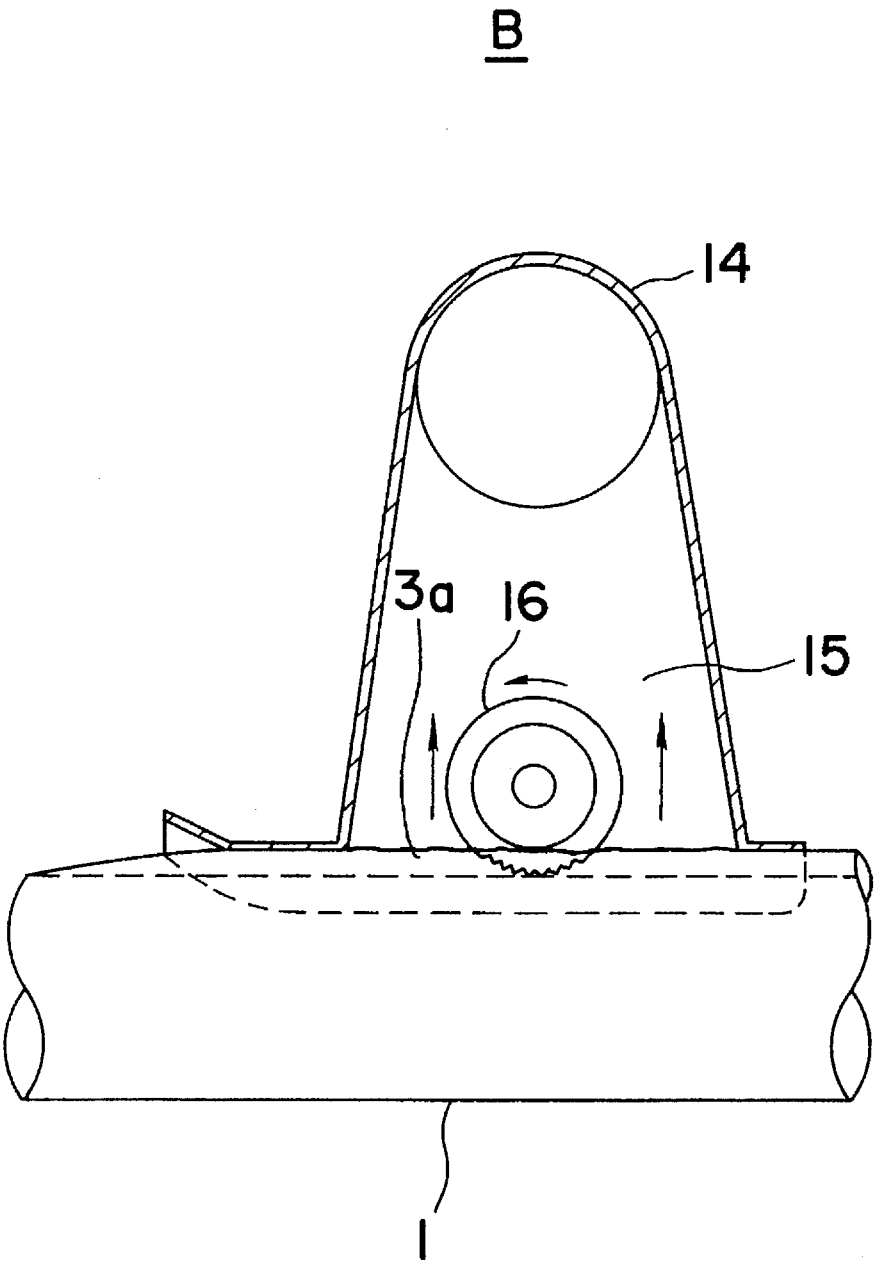
FIG. 8 is a cross sectional view showing an operation of the packing material cutting unit in FIG. 7.
Figure 9:
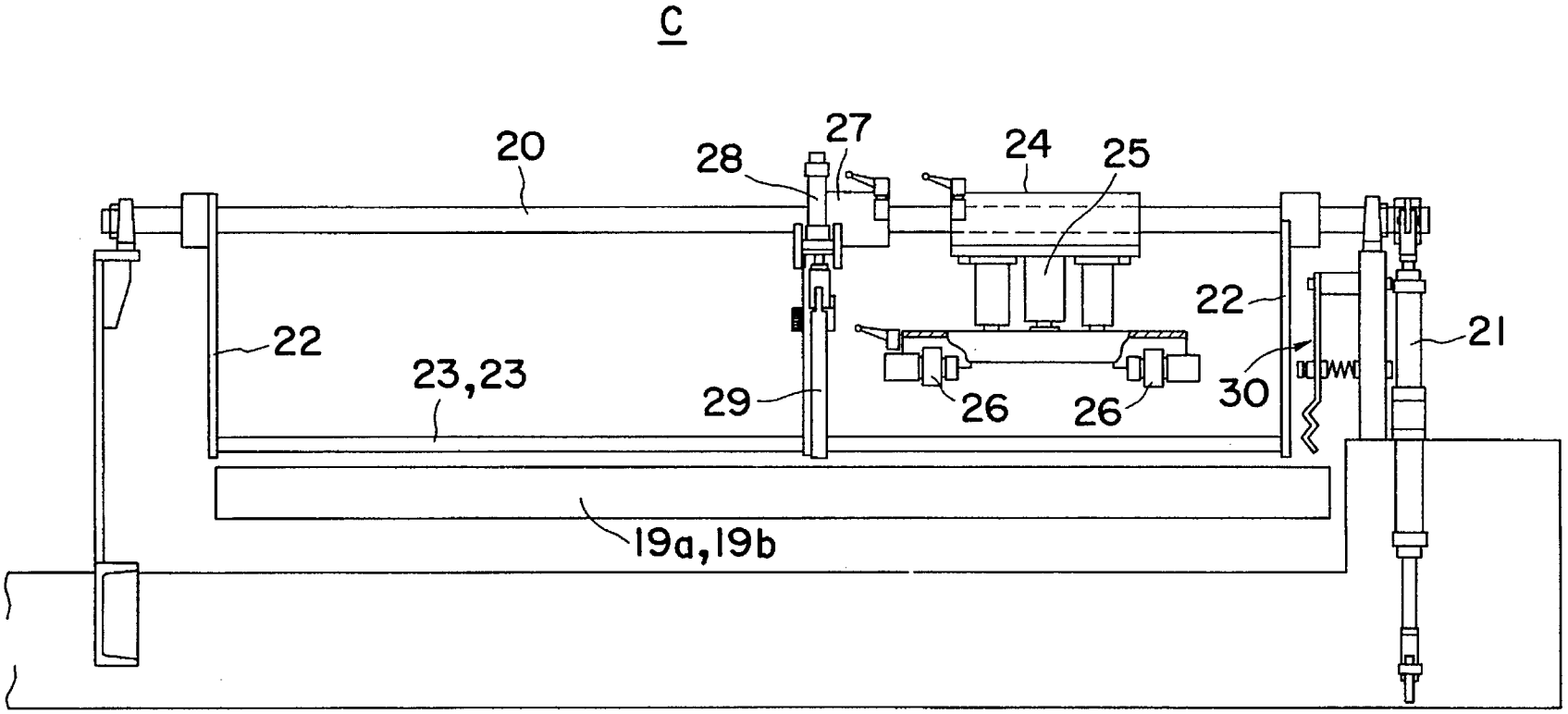
FIG. 9 is a side view of a packing material removal unit according to this invention.

In the packing material cutting unit B, when the package 1 passes under the suction opening 15, as is best shown in FIG. 8, a slack or loosened section 3*a* of the packing material 3 is so formed that the packing material 3 is sucked upwardly by the suction duct 14. The slack section 3*a* is cut by the cutter 17 while the package 1 is moved forward. Moreover, the height positions of the suction duct 14, the suction opening 15 and the cutter 17 can be adjusted by moving up and down the support body 18 in accordance with the size of the package 1.

Figure 10:
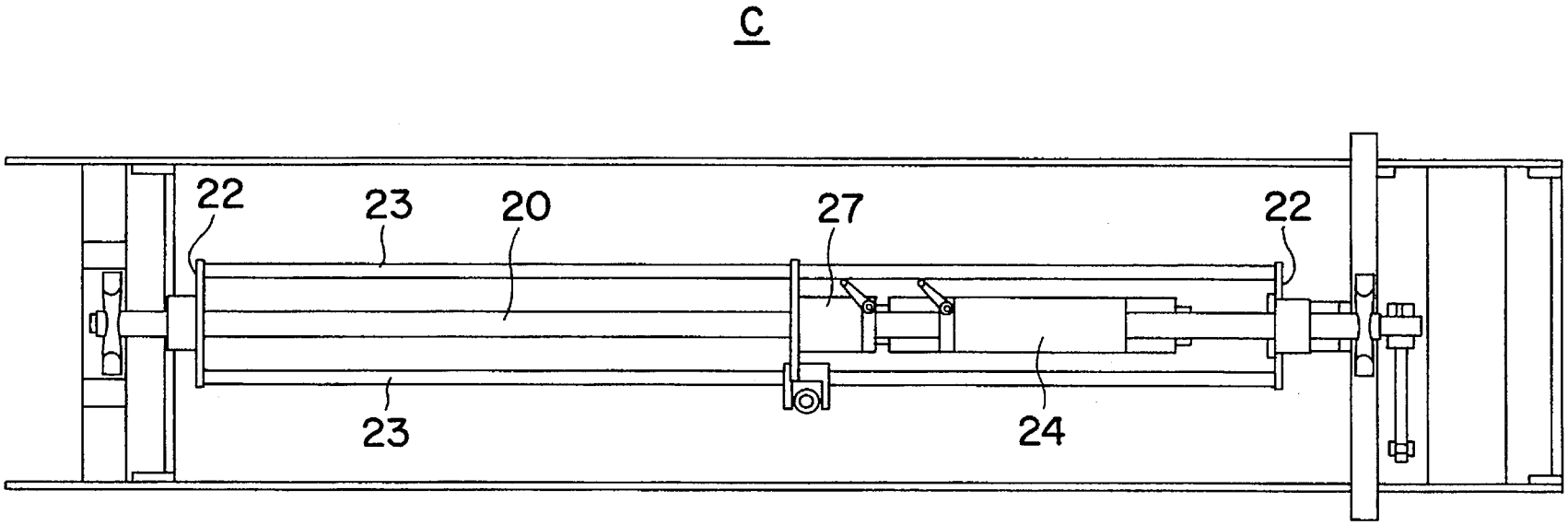
FIG. 10 is a plan view of the packing material removal unit in FIG. 9.
Figure 11:
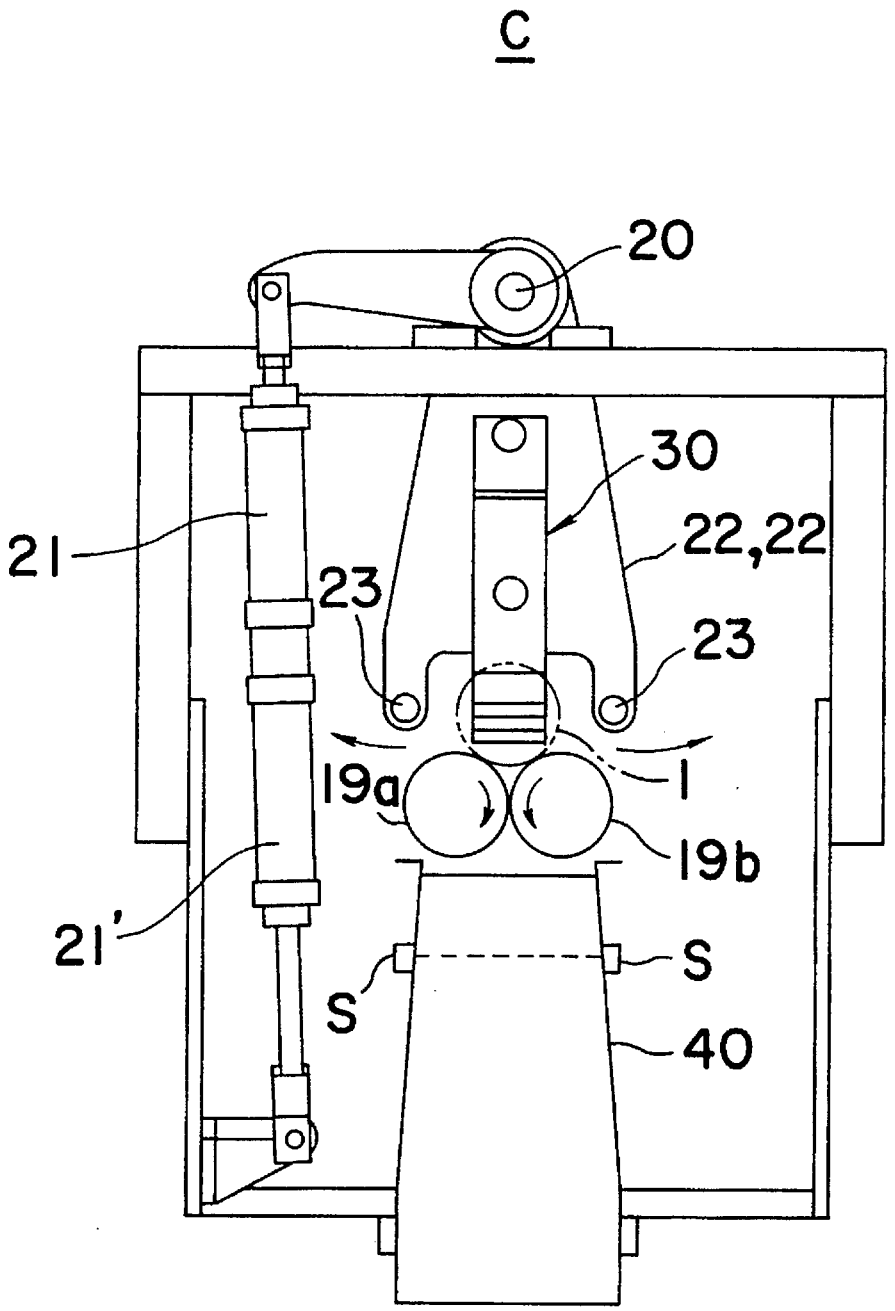
FIG. 11 is a rear view of the packing material removal unit in FIG. 9.

The package 1 whose packing material 3 is cut in the packing material cutting unit B is carried from a position on the guide portion 13*a* to a position on the removal rollers 19*a*, 19*b* in the packing material removal unit C. In the packing material removal unit C, the package 1 carried from the packing material cutting unit B is, as shown in FIG. 11, located between a pair of bars 23 supported by the swinging plates 22 while being slit on the removal rollers 19*a*, 19*b* until the package 1 abuts against the end stopper 30. At this time, the shutter 29 swings upwardly (the state shown by a chain line in FIG. 12) by operating the cylinder 28, permits the package 1 to pass therethrough and swing in the opposite direction after the package 1 passes therethrough to support the back end of the package 1. The position of the shutter 29 is determined corresponding to the length of the package 1 in its axial direction by sliding the bracket 27 along the shaft 20 (FIG. 10).

When the package 1 is positioned by the end stopper 30, the press rollers 26 are lowered by expanding the cylinder 25 to press the upper surface of the package 1. The press rollers 26 are positioned above the package 1 by sliding the movable sleeve 24 along the shaft 20.

In this state, the removal rollers 19*a*, 19*b* are rotated in the inside direction (the direction of an arrow in FIG. 12) to each other. Therefore, the packing material 3 whose upper portion is cut is peeled off from the can lids 2 while the packing material 3 is drawn between the removal rollers 19*a*, 19*b*. The packing material 3 peeled off from the can lids 2 is dropped into the discharge shoot 40. At this time, the can lids 2 from which the packing material 3 is stripped off are not separated from each other because the removal rollers 19*a*, 19*b* are slightly declined toward the downstream side, the front portion of the can lids 2 abut against the end stopper 30 while the back end portion thereof is supported by the shutter 29.

Since the grooves 19'*a*, 19'*b* are formed at the outer circumferential surfaces of the removal rollers 19*a*, 19*b*, when the packing material 3 is stripped off therefrom, a slip between the packing material 3 and removal rollers 19*a*, 19*b* can be effectively prevented. Therefore, a reliable removal of the packing material 3 can be ensured. Furthermore, since the grooves 19'*a*, 19'*b* are intermittently formed in the axial direction of the removed rollers 19*a*, 19*b*, there is no fear that the packing material 3 is bitten into the grooves 19'*a*, 19'*b*.

When the packing material 3 is not stripped off from the package 1 and the sensors S do not detect the dropping of the packing material 3 into the removal shoot 40, the shaft 20 is rotated in the counter-clockwise direction in FIG. 12 by the operation of the cylinder 21. Therefore, the swing board 22 and the bars 23 are swung in the direction toward the discharge unit E to discharge the defectived package to the discharge shoot 42 from the upper position of the removal rollers 19*a*, 19*b*.

When the packing material 3 is stripped off from the package 1 and the sensors S detects the dropping of the packing material 3 into the removal shoot 40, the shaft 20 is rotated in the clockwise direction in FIG. 12 by the operation of the cylinder 21'. Therefore, the swinging board 22 and the bars 23 are swung in the direction toward the dropping unit D to move the can lids 2 from the upper position of the removal rollers 19*a*, 19*b* to the upper position of the transfer board 31.

In the dropping unit D, the can lids 2 moved from the removal rollers 19*a*, 19*b* roll down on the transfer board 31 between the side boards 32*a*, 32*b*, and are stopped by the shutter board 33*a* positioned at a projected position projected upward from the slit 31*a* of the transfer board 31. At this time, the can lids 2 are not separated from each other because both ends of the can lids 2 are caught by the side boards 32*a*, 32*b*, respectively.

When no can lid exists between the side boards 32*a*', 32*b*', the shutter board 33*a* is lowered by the operation of the cylinder 34*a*. Thereby, the can lids 2 positioned between the side boards 32*a*, 32*b* move into the side boards 32*a*' and 32*b*' while rolling on the transferring board 31, and is stopped by the shutter board 33*b* positioned at a projected position projected upward from the slit 33*b* of the transferring board 31. At this time, the can lids 2 are not separated from each other because both ends of the can lids 2 is caught by the side boards 32*a*', 32*b*'. Thereafter, the shutter board 33*a* is raised by the operation of the cylinder 34*a* to wait for the next can lids 2.

When no can lids carried ahead exist in the supplying unit F, the shutter board 33*b* is lowered by the operation of the cylinder 34*b* to move the can lid 2 positioned between the side boards 32*a*', 32*b*' to the supplying unit F while rolling on the transfer board 31. Afterward, the shutter board 33*b* is raised by the operation of the cylinder 34*b* to wait for the next can lids 2.

At this time, in the carrying unit A, the packing material cutting unit B and the packing material removal unit C, the operations mentioned above are performed, respectively.

The can lids 2 carried to the supplying unit F is put on the endless belt 50. And, the can lids 2 are not separated from each other because the front end of the can lids 2 is attached to the back end of the can lids 2 carried ahead and the back end of the can lids 2 is pushed by the cylinder 51.

In this state, the can lids 2 is supplied to the seamer by operating the endless belt 50.

We claim:

1. A packing material removal apparatus for removing a packing material from a package including a plurality of combined articles therein and a sheet-like packing material for packing the combined articles and supplying the combined articles to a next process by a supplying unit, the apparatus comprising:

a cutting unit having a suction opening for sucking the packing material to form a slack section having a space between the packing material and the combined articles, and a cutter for cutting the slack section;

a removal unit having a pair of removal rollers which rotate in opposite directions to each other while the package cut in the cutting unit is put on the removal rollers to remove the packing material from the package by biting the packing material between the removal rollers; and a dropping unit having a transferring board provided between the removal unit and the supplying unit in a state wherein the combined articles can be moved on the transferring board, at least one pair of shutter members, provided parallel to the removal rollers and projected from a lower side of the transferring board through openings formed in the transferring board, which have support portions respectively formed by bending lower portions thereof and disposed under the transferring board so that an edge of the bent lower portions face each other, wherein the support portions are formed so that said edges which face each other have a concave-convex form for fitting or mating with each other, at least one pair of cylinder members for moving the shutter members up and down with respect to the transferring board provided parallel to the shutter members under the support portions, whose operating shafts are respectively connected to the convex portions of the support portions so as to alternately move upwardly and downwardly with respect to each other to stop the combined articles on the transferring board and to release the combined articles to the supplying unit, at least one pair of guide shafts provided in alignment with the operating shafts of the cylinder members and respectively connected to the convex portions of the support portions of the shutter members so that the shutter members are moved up and down in a perpendicular direction to the transferring board, and side boards provided for restricting both ends of the combined articles on the transferring board.

2. The packing material removal apparatus according to claim 1, further comprises a carrying unit having a guide portion extended toward the removal unit for carrying the package to the removal unit along the guide portion.

3. The packing material removal apparatus according to claim 2, wherein the carrying unit comprises a feeding section for supplying the package to a carrying course; and a carrying section having a pusher for advancing the package supplied from the feeding section to the cutting unit and the removal unit along a rail.

4. The packing material removal apparatus according to claim 3, wherein the carrying unit further comprises a waiting section provided adjacent to the feeding section for waiting for the package to be transferred to the carrying section.

5. The packing material removal apparatus according to claim 4, wherein the waiting section comprises an endless timing belt for putting the package supplied from a feeding section for supplying the package to a carrying course thereon.

6. The packing material removal apparatus according to claim 3, wherein the carrying unit further comprises a transferring section for transferring the package located at the waiting section to the carrying section.

7. The packing material removal apparatus according to claim 1, wherein the suction opening of the cutting unit is connected to a suction source via a suction duct.

8. The packing material removal apparatus according to claim 1, wherein the cutter in the cutting unit is disposed inside of the suction opening so as to be rotated by a motor disposed inside of the suction opening.

9. The packing material removal apparatus according to claim 1, wherein the suction opening, the cutter and the motor are supported by a support body whose height is adjustable.

10. The packing material removal apparatus according to claim 1, wherein a plurality of grooves are formed in an axial direction of the removal rollers at outer circumferential surfaces of the removal rollers, respectively.

11. The packing material removal apparatus according to claim 10, wherein the grooves are intermittently formed in axial direction of the removal rollers.

12. The packing material removal apparatus according to claim 1, wherein the removal unit comprises a press plate installed so as to be swung in an axial direction of the removal rollers, a lower end portion of the press plate touching a front end face of the package put on the removal rollers; and an elastic member for urging the press plate so as to touch, at its lower end, the front end face of the package.

13. The packing material removal apparatus according to claim 1, wherein the removal unit comprises a shutter provided so as to swing in a direction perpendicular to an axis of the removal rollers, the shutter opening and closing a transferring course of the package, the shutter supporting a back end portion of the package which is put on the removal rollers and supported at its front end face by an end stopper when the shutter closes the transferring course.

14. The packing material removal apparatus according to claim 1, wherein the removal unit comprises a pair of bars positioned along both sides of the package put on the removal rollers so as to be extended parallel to the removal rollers, the bars being able to swing in a direction perpendicular to the axis of the removal rollers, the bars moving the package laterally of the removal rollers by pushing a side surface of the package when the bars swing.

15. The packing material removal apparatus according to claim 1, wherein the removal unit comprises a removal shoot disposed under the removal rollers, the packing material removed from the package being dropped into the removal shoot.

16. The packing material removal apparatus according to claim 1, further comprising a discharge unit for discharging a defective package from which the packing material is not removed, a discharge shoot being disposed on an opposite side of the dropping unit with respect to the removal rollers.

17. The packing material removal apparatus according to claim 15, wherein a sensor is installed at the removal shoot for sensing dropping of the packing material into the removal shoot, a pair of bars being disposed on both sides of the package put on the removal rollers, the bars being swung toward the dropping unit when the sensor senses dropping of the packing material into the removal shoot, the bars being swung toward a discharge unit for discharging a defective package when the sensor does not sense dropping of the packing material into the removal shoot.

18. The packing material removal apparatus according to claim 1, wherein the removal unit comprises a press roller disposed over the removal rollers movably upward and downward to press the package put on the removal rollers.

19. The packing material removal apparatus according to claim 1, wherein the shutter member comprises at least one pair of plates disposed parallel to each other so that an interval therebetween is slightly longer than a length of the package.

20. The packing material removal apparatus according to claim 1, wherein an operating means is connected to at least one of the side boards of the dropping unit, the operating means sliding the side boards in a perpendicular direction to a moving direction of the package with respect to the transferring board, thereby an interval of both side boards being adjustable.

* * * * *